US011731004B2

(12) United States Patent
Wang et al.

(10) Patent No.: US 11,731,004 B2
(45) Date of Patent: Aug. 22, 2023

(54) VERTICAL OSCILLATION AUXILIARY PLATFORM

(71) Applicant: Maizu Intelligent Technology (Shanghai) Co., Ltd., Shanghai (CN)

(72) Inventors: Shih-jung Wang, Shanghai (CN); Hailong Wang, Shanghai (CN)

(73) Assignee: MAIZU INTELLIGENT TECHNOLOGY (SHANGHAI) CO., LTD., Shanghai (CN)

( * ) Notice: Subject to any disclaimer, the term of this patent is extended or adjusted under 35 U.S.C. 154(b) by 70 days.

(21) Appl. No.: 17/504,589

(22) Filed: Oct. 19, 2021

(65) Prior Publication Data

US 2023/0055925 A1 Feb. 23, 2023

(30) Foreign Application Priority Data

Aug. 17, 2021 (CN) ..... 202110943954.6

(51) Int. Cl.
*A63B 22/18* (2006.01)

(52) U.S. Cl.
CPC ..... *A63B 22/18* (2013.01); *A63B 2208/0204* (2013.01); *A63B 2208/0228* (2013.01)

(58) Field of Classification Search
CPC ..... A63B 22/18; A63B 2208/0204; A63B 2208/0228; A63B 21/00178; A63B 21/4033; A63B 2208/0209; A61H 1/005; A61H 23/0254; A61H 2201/1215; A61H 2201/123; A61H 2201/149; A61H 2201/1666; A61H 2201/1676; A61H 2201/5005; A61H 2201/501
See application file for complete search history.

(56) References Cited

U.S. PATENT DOCUMENTS 4,061,137 A * 12/1977 Sandt ..... A61G 13/009 5/915
4,787,630 A * 11/1988 Watson ..... A63B 22/14 482/146

(Continued)

FOREIGN PATENT DOCUMENTS

EP 1541112 A1 * 6/2005 ..... A61H 1/005
JP 2004031731 A * 1/2004

*Primary Examiner* — Garrett K Atkinson
(74) *Attorney, Agent, or Firm* — McClure, Qualey & Rodack, LLP

(57) ABSTRACT

A vertical oscillation auxiliary platform, wherein a drive mechanism drives an upper cover tread board to make vertical up-and-down movements with a transmission mechanism; when the drive mechanism drives a transmission shaft rotate, the transmission shaft drives lower parts of 8-shaped bearing blocks to rotate eccentrically, and upper parts thereof move horizontally; the 8-shaped bearing blocks drive one end of triangular bearing blocks to move horizontally with horizontal transmission rods, and the triangular bearing blocks, without moving a third end, convert horizontal movements at one end to be vertical movements at another end, and drive finally the upper cover tread board to generate stable vertical oscillation, so that singularity and stability of vertical movements of the upper cover tread board can be promised, and more stable and comfortable feeling and passive exercise effects can be gained, without deteriorating the exercise effects and exercise comfort due to additional disorganized lateral movements.

6 Claims, 3 Drawing Sheets

(56) References Cited

U.S. PATENT DOCUMENTS 5,897,474 A * 4/1999 Romero ..... A63B 22/14 482/79
6,468,236 B1 * 10/2002 Sumanac ..... A63B 23/0211 601/60
6,872,175 B2 * 3/2005 Lin ..... A63B 26/003 482/121
7,357,766 B2 * 4/2008 Langer ..... A63B 22/18 482/146
7,431,681 B1 * 10/2008 St. Cyr ..... A63B 21/0552 482/121
7,601,107 B2 * 10/2009 Maloy ..... A63B 23/1245 482/79
7,854,709 B2 * 12/2010 Neff ..... A61H 23/0263 601/51
7,985,164 B2 * 7/2011 Ashby ..... H04L 67/12 482/901
8,171,582 B1 * 5/2012 Nikolaev ..... A61G 7/012 5/915
2004/0018924 A1 * 1/2004 Szydlowski ..... A63B 22/18 482/146
2004/0023766 A1 * 2/2004 Slone ..... A63B 26/003 482/146
2004/0087421 A1 * 5/2004 Lin ..... A63B 26/003 482/148
2005/0170939 A1 * 8/2005 Lin ..... A63B 26/003 482/121
2007/0265138 A1 * 11/2007 Ashby ..... A63B 22/0235 482/8
2009/0139354 A1 * 6/2009 Wu ..... A61H 1/005 74/25
2009/0234257 A1 * 9/2009 Wu ..... A61H 1/005 601/49
2010/0312154 A1 * 12/2010 Becker ..... A61H 1/005 601/49
2012/0208684 A1 * 8/2012 Huang ..... A61H 23/0254 482/146
2013/0012849 A1 * 1/2013 Seaton ..... A63B 21/00196 601/24
2017/0014301 A1 * 1/2017 Lin ..... A61H 23/0263
2020/0097088 A1 * 3/2020 Welch ..... A63F 13/28
2022/0071830 A1 * 3/2022 Ko ..... A61H 1/001
2022/0133575 A1 * 5/2022 Chang ..... A63B 21/00196 248/559

* cited by examiner

VERTICAL OSCILLATION AUXILIARY PLATFORM

TECHNICAL FIELD

The present invention relates to the fitness equipment field, and especially a vertical oscillation auxiliary platform.

BACKGROUND TECHNOLOGY

With growth of the society, people's living pace has become quicker and quicker, and in the fast-paced working and learning process, more and more health problems occur, a variety of negative states such as fatigue, worries and anxiety etc. gradually bring human to a sub-health state or even illness. In light of the foregoing circumstance, people are driven to take all kinds of exercises, however, the exercise time is limited by the fast-paced learning and working, in this regard, a lot of exercise equipment appears, so that people can perform some passive exercises with scattered spare time in a busy life effectively and gain good effects.

Among all kinds of indoor leisure activities, people wish to train their physical fitness and body shapes, therefore, facilities such as treadmills and steppers are popular. However, running and stepping belongs to high strength active exercises, with a high demand on cardio-pulmonary functions of the exerciser(s), and in the meantime, running and stepping may hurt knee joints, so not a lot of people can insist for long. In view of the foregoing conditions, vertical oscillation devices are designed, by vertical oscillation, the human bodies can oscillate regularly, so exercise effects can be achieved no matter when people are standing, sitting or lying.

There are various forms of vertical oscillation devices commercially available, such as tread board style ones, bed-style ones, and gait trainer style ones, all of these vertical oscillation devices have different appearances, however, they share the same core, which comprises an oscillation platform, with which the equipment can make regular vertical oscillation. For example, the applicant has ever proposed a similar device in Chinese patent application no. CN201910278551.7, wherein rotation of eccentric wheels are converted into linear vertical movement ingeniously. However, among the vertical oscillation auxiliary platforms commercially available, although allegedly vertical oscillation is generated, U-shaped oscillation is actually generated rather than only vertical oscillation, in this way, during use, the equipment itself is not stable and safe enough, consequently, people cannot get good exercise feelings and passive exercise effects. Therefore, it is urgent to develop a real vertical oscillation auxiliary platform which can output only vertical movement effectively and stably to solve the foregoing problems.

SUMMARY OF THE INVENTION

A purpose of the present invention is to address deficiencies of the prior art and adapt to consumers' need, and provide a vertical oscillation auxiliary platform that can output only vertical movement effectively and stably.

To realize the foregoing purpose of the present invention, the technical solution adopted by the present invention is:

A vertical oscillation auxiliary platform,

Comprises a pedestal, an upper cover tread board, a drive mechanism and a transmission mechanism; wherein the pedestal is used to support the drive mechanism and the transmission mechanism; the drive mechanism comprises a motor, wherein the motor is fixed on the pedestal, and the motor is connected with the transmission mechanism by belt transmission; wherein the transmission mechanism drives the upper cover tread board to make vertical up-and-down movements;

Wherein the transmission mechanism comprises a transmission shaft that is horizontally provided, the transmission shaft is pivoted on bearing blocks by ball bearings and capable of free rotation, the bearing blocks are provided on the pedestal; a belt pulley is provided on the transmission shaft, and the belt pulley is transmissively connected with an output shaft of the motor by one or more belts;

Two sets of transmission assemblies are symmetrically provided on both sides of the transmission shaft, and an 8-shaped bearing block, a horizontal transmission rod and two triangular bearing blocks are provided in each of the two sets of transmission assemblies; wherein for each of the two sets of transmission assemblies, one end of the 8-shaped bearing block is an eccentric end, and another end thereof is a horizontal action end, a circular hole is provided respectively on both ends of the 8-shaped bearing block and a ball bearing is provided in the circular hole; totally three circular holes are provided on an intermediate portion and both ends of the horizontal transmission rod; each of the two triangular bearing blocks comprises a fixing end, a horizontal action end and a vertical action end, a circular hole is provided respectively in the fixing end, the horizontal action end and the vertical action end of each of the two triangular bearing blocks, and in the circular hole is provided a ball bearing; an eccentric bushing is provided respectively on both ends of the transmission shaft, and the eccentric bushing is connected in an axle hole of the ball bearing in the circular hole provided at the eccentric end of the 8-shaped bearing block; the circular hole at the horizontal action end of the 8-shaped bearing block is connected with the circular hole at the intermediate portion of the horizontal transmission rod by one or more connection pins; the circular holes at both ends of the horizontal transmission rods are respectively connected with the circular holes provided on the horizontal action ends of the triangular bearing blocks by the one or more connection pins; the circular holes at the fixing ends of the triangular bearing blocks are respectively connected with pedestal connection pieces by the one or more connection pins and the pedestal connection pieces are fixed on the pedestal; and the circular holes at the vertical action ends of the triangular bearing blocks are connected with upper cover connection pieces by the one or more connection pins, and the upper cover connection pieces are provided on a bottom portion of the upper cover tread board.

Further, the motor is installed on a motor fixing seat, and the motor fixing seat is connected on the pedestal.

Further still, the drive mechanism comprises a control module, wherein the control module controls the motor to rotate.

Still further, a level adjustment mechanism is provided on a bottom surface of the pedestal, and the level adjustment mechanism comprises height adjustment bolts provided on the bottom surface of the pedestal.

Further still, one or more intermediate transmission pulleys are provided between the motor and the transmission mechanism, and transmission is done indirectly by the one or more intermediate transmission pulleys.

Still further, where there are two intermediate transmission pulleys, the output shaft of the motor is connected to a first intermediate transmission pulley by belt transmission, the first intermediate transmission pulley is connected to a second intermediate transmission pulley by a shaft, and the second intermediate transmission pulley is connected to the belt pulley provided on the transmission shaft by belt transmission.

Beneficial effects of the present invention are:

The present invention is ingenious, highly efficient, safe, stable, and comfortable and realizes perfectly pure up and down vertical drive.

In the vertical oscillation auxiliary platform, the drive mechanism drives the upper cover tread board to move with the transmission mechanism; when the drive mechanism drives the transmission shaft to rotate, the transmission shaft drives lower parts of the 8-shaped bearing blocks to rotate eccentrically and upper parts of the 8-shaped bearing blocks to move horizontally back and forth; the 8-shaped bearing blocks then drive an end of each of the triangular bearing blocks to move back and forth with the horizontal transmission rods, and the triangular bearing blocks, as a core of the present invention, convert horizontal movements at one end to be vertical movement of another end without moving a third end, and so drive the upper cover tread board to make stable up-and-down vertical oscillation without generating additional lateral movement, thus singularity and stability of vertical movements of the upper cover tread board can be promised, the exerciser(s) can get more stable and comfortable feelings and passive exercise effects without deteriorating exercise effects and comfort of exercise feelings by additional and disorganized lateral movements.

The level adjustment mechanism provided on the bottom surface of the pedestal promises that the pedestal of the present invention is in an a flat position, so that running of the equipment is stable, safe and jamming free, and exercise experiences of the users can be more stable and safer.

A transmission manner of the present invention can be customized, it is possible not to make transmission between the drive mechanism and the transmission mechanism directly but indirectly via one or more intermediate transmission pulleys and the number and transmission ratio of the one or more intermediate transmission pulleys can be self-defined, so as to build different equipment.

What is provided in the present invention is a platform, and different casings can be designed based on the platform and equipment of different forms can be built, so that the application range is very wide, and standardized fabrication can be done in this regard to improve production efficiency and enhance product quality.

BRIEF DESCRIPTION OF THE DRAWINGS

Hereinafter the present invention is further described in conjunction with the accompanying drawings and embodiments.

Figure 1:
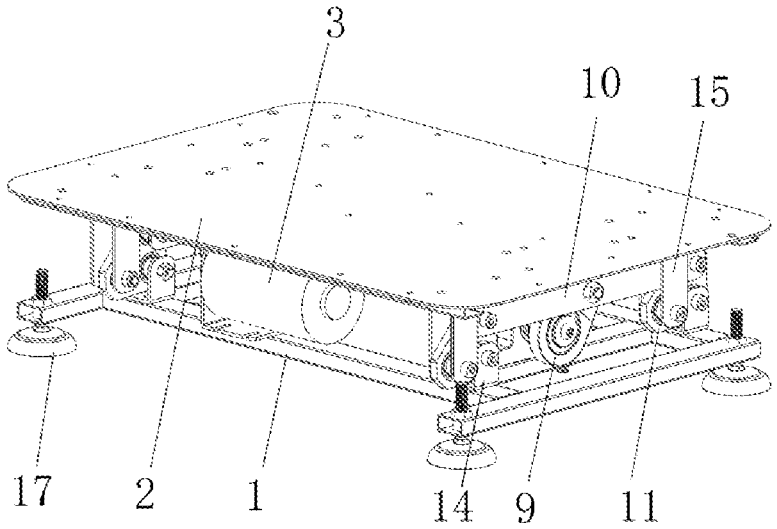
FIG. 1 is an overall structural diagram of an embodiment of the present invention (viewing angle one)

In the drawings: 1. Pedestal; 2. Upper cover tread board; 3. Motor; 4. Transmission shaft; 5. Ball bearing; 6. Bearing block; 7. Belt pulley; 8. Intermediate transmission pulley; 9. 8-shaped bearing block; 10. Horizontal transmission rod; 11. Triangular bearing block; 12. Eccentric bushing; 13. Connection pin; 14. Pedestal connection piece; 15. Upper cover connection piece; 16. Motor fixing seat; 17. Height adjustment bolt; and 18. Belt.

EMBODIMENTS

Hereinafter the present invention will be described in detail in conjunction with the accompanying drawings, and a clear and complete description will be given to the technical solution in embodiments of the present invention, apparently, the embodiments described here are only some of the embodiments of the present invention instead of all. Based on the embodiments provided in the present invention, all other embodiments obtained by those of ordinary skill in the art without making creative effort fall into protection scope of the present invention.

It should be noted that when a component is referred to as being "fixed to" another component, it can be directly on the other component or an intermediate component may also exist. When a component is considered to be "connected" to another component, it can be directly connected to the other component or there may be an intermediate component at the same time. When a component is considered to be "installed on" another component, it can be directly installed on another component or an intermediate component may exist at the same time. The terms "vertical", "horizontal", "left", "right" and similar expressions used herein are for illustrative purposes only.

Unless otherwise defined, all technical and scientific terms used herein have the same meaning as commonly understood by those skilled in the technical field of the present invention. The terms used in the description of the present invention herein are only for the purpose of describing specific embodiments, and are not intended to limit the present invention. The term "and/or" as used herein includes any and all combinations of one or more related listed items.

Herein the present invention provides a kind of vertical oscillation auxiliary platform as shown in FIG. 1 to FIG. 6.

Figure 2:
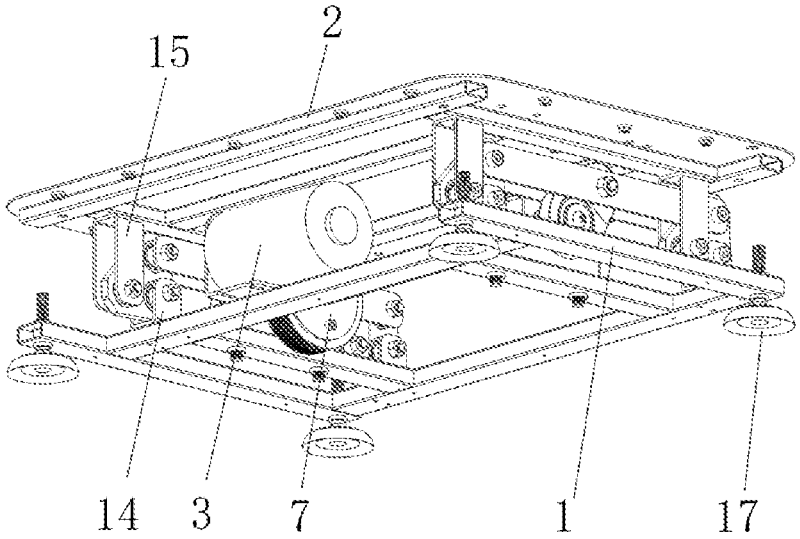
FIG. 2 is another overall structural diagram of an embodiment of the present invention (viewing angle two)

With reference to FIG. 1 and FIG. 2, in the present embodiment, the vertical oscillation auxiliary platform comprises a pedestal 1 and an upper cover tread board 2, and a drive mechanism and a transmission mechanism are provided between the upper cover tread board 2 and the pedestal 1; the pedestal 1 is used to support the drive mechanism and the transmission mechanism; the drive mechanism comprises a motor 3, wherein the motor 3 is fixed on the pedestal 1 and connected with the transmission mechanism by belt transmission; and the transmission mechanism drives the upper cover tread board 2 to make vertical up-and-down movements.

A level adjustment mechanism is provided on a bottom surface of the pedestal 1, wherein the level adjustment mechanism comprises height adjustment bolts 17 provided on the bottom surface of the pedestal 1. The level adjustment mechanism can promise the pedestal 1 to be in a horizontal position, so that running of the device is more stable, safer and jamming free. Exercise experiences of the users can be more smooth and safer.

Figure 3:
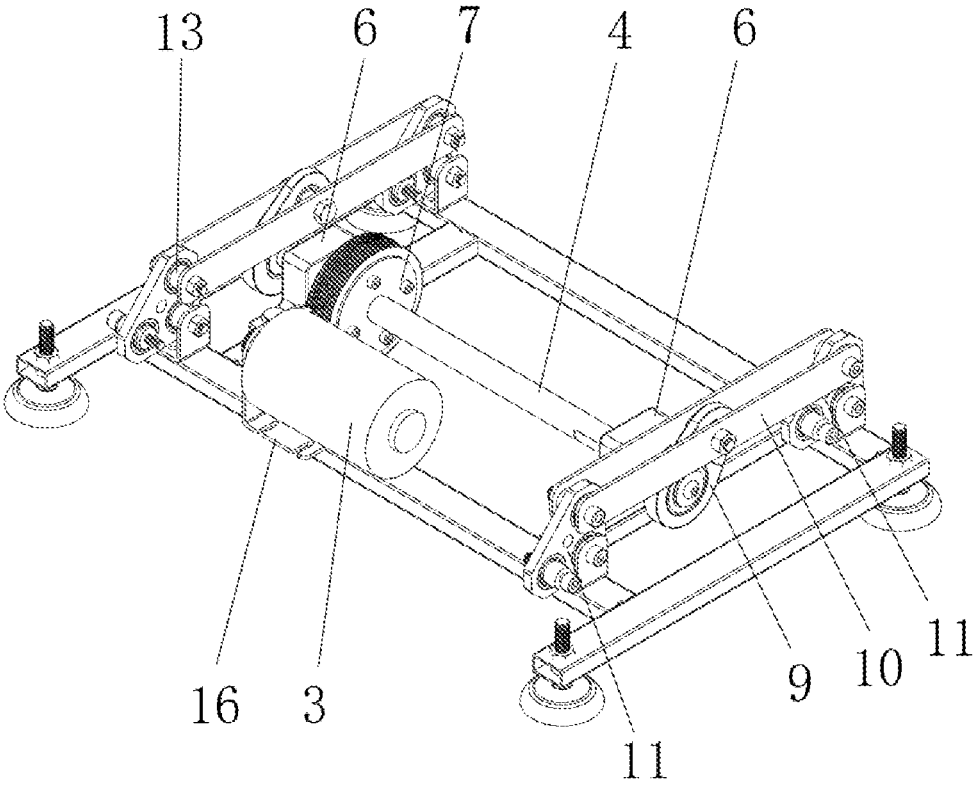
FIG. 3 is a structural diagram showing an embodiment of the present invention without the upper cover tread board.
Figure 4:
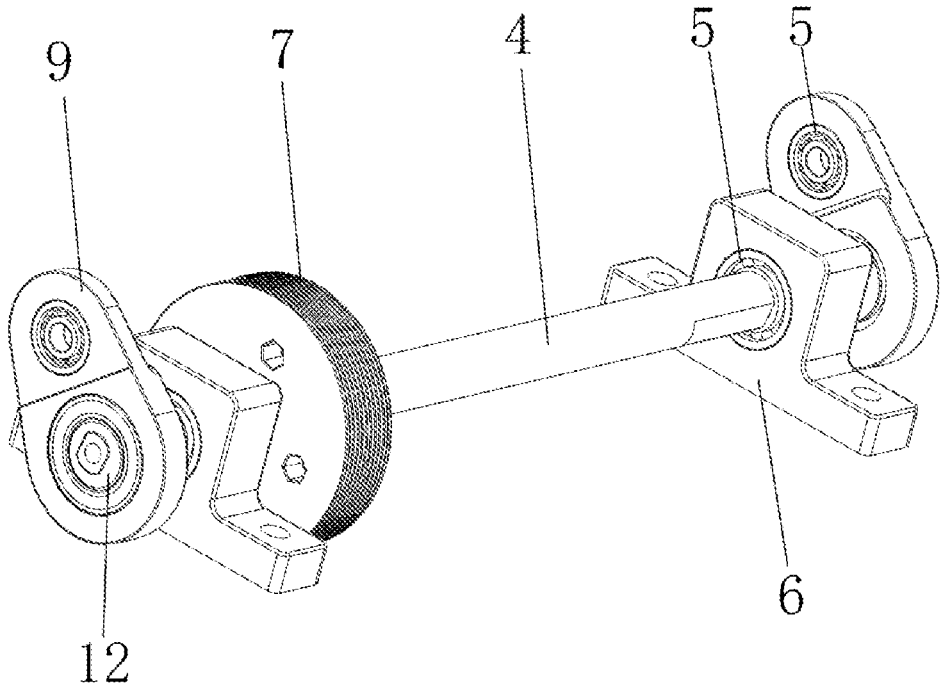
FIG. 4 is a partially enlarged view of some parts of the present invention.
Figure 5:
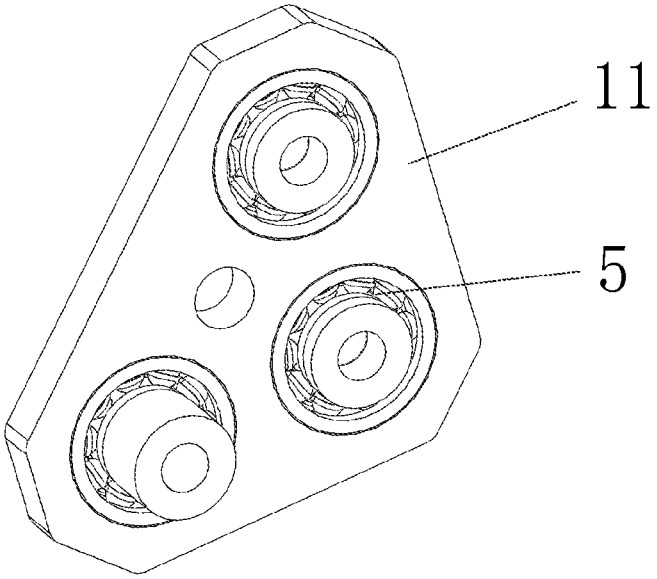
FIG. 5 is an enlarged view of the triangular bearing block of the present invention.

With reference to FIG. 3 to FIG. 5, the transmission mechanism comprises a horizontally provided transmission shaft 4, wherein the transmission shaft 4 is pivoted on bearing blocks 6 and capable of free rotation, and the bearing blocks 6 are fixed on the pedestal 1; a belt pulley 7 is provided on the transmission shaft 4, and the belt pulley 7 is transmissively connected with an output shaft of the motor 3 by one or more belts, note: the one or more belts have not been shown here in the drawings, which doesn't affect understanding of the present invention. The motor 3 is installed on a motor fixing seat 16 and the motor fixing seat 16 is connected on the pedestal 1.

Two sets of transmission assemblies are symmetrically provided on both sides of the transmission shaft 4, and each of the two sets of transmission assemblies comprises an 8-shaped bearing block 9, a horizontal transmission rod 10 and two triangular bearing blocks 11. With reference to FIG. 4, an end of each of the 8-shaped bearing blocks 9 is an eccentric end, another end thereof is a horizontal action end, a circular hole is respectively provided on both ends of the 8-shaped bearing blocks 9, and a ball bearing 5 is respectively installed in the circular holes; totally three circular holes are provided in an intermediate portion and both ends of each of the horizontal transmission rods 10; with reference to FIG. 5, the triangular bearing blocks 11 comprise respectively a fixing end, a horizontal action end and a vertical action end, a circular hole is respectively provided in all the three ends of each of the triangular bearing blocks 11, and a ball bearing is provided in each of the circular holes; with reference to FIG. 4, an eccentric bushing 12 is provided on each end of the transmission shaft 4, and the eccentric bushings 12 are connected respectively in axle holes of the ball bearings provided in the circular holes at the eccentric ends at lower ends of the 8-shaped bearing blocks 9; the circular holes provided in the horizontal action ends of the 8-shaped bearing blocks 9 are connected respectively with the circular holes provided in the intermediate portions of the horizontal transmission rods 10 by connection pins 13; the circular holes at both ends of the horizontal transmission rods 10 are respectively connected with the circular holes in the horizontal action ends of the triangular bearing blocks 11 by the connection pins 13; the circular holes at the fixing ends of the triangular bearing blocks 11 are connected with pedestal connection pieces 14 by the connection pins 13, and the pedestal connection pieces 14 are fixed on the pedestal 1, which can be seen in FIG. 1 and FIG. 2; and the circular holes at the vertical action ends of the triangular bearing blocks 11 are connected with upper cover connection pieces 15 by the connection pins 13 and the upper cover connection pieces 15 are fixed on a bottom portion of the upper cover tread board 2, which can be seen in FIG. 1 and FIG. 2.

Figure 6:
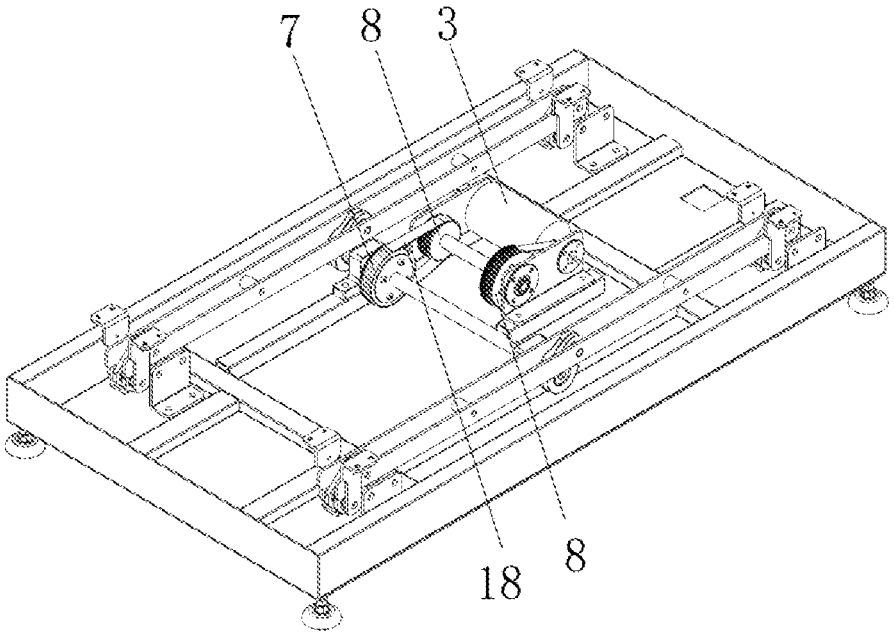
FIG. 6 is an overall structural diagram showing another embodiment of the present invention.

As shown in FIG. 6, in another embodiment of the present invention, one or more intermediate transmission pulleys 8 are provided between the motor 3 and the belt pulley 7, and transmission is done indirectly by the one or more intermediate transmission pulleys 8. In FIG. 6 two intermediate transmission pulleys 8 are shown, wherein the output shaft of the motor 3 is connected with a first intermediate transmission pulley 8, the first intermediate transmission pulley 8 is connected with a second intermediate transmission pulley 8 by a shaft and the second intermediate transmission pulley 8 is connected with the belt pulley 7 provided on the transmission shaft 4 by one or more belts 18. It is comprehensible that, when there are more intermediate transmission pulleys, the same rule applies. Therefore, number and transmission ratio of the one or more intermediate transmission pulleys 8 can be customized to adapt to different needs.

Principles and usage methods of the present invention are as following: during use, place the pedestal 1 horizontally, and by adjusting with the height adjustment bolts 17, the pedestal 1 can be in a horizontal state; when it is necessary to start the vertical oscillation auxiliary platform, control the motor 3 to rotate with a control module, rotation of the motor 3 will drive the one or more intermediate transmission pulleys 8 to rotate, or drive directly the belt pulley 7 to rotate, so as to drive the transmission shaft 3 to rotate, and revolution of the transmission shaft will be converted to be reciprocal horizontal movements by coordination of the eccentric bushings 12 and the 8-shaped bearing blocks 9, the horizontal transmission rods 10 then drive the reciprocal horizontal movements to the triangular bearing blocks 11, the triangular bearing blocks 11 convert the reciprocal horizontal movements to be reciprocal vertical movements, and drive the upper cover tread board to generate stable vertical up-and-down oscillation, and no additional lateral movements are generated during this process, so as to promise singularity and stability of the vertical movements of the upper cover tread board, and gain more comfortable and stable feelings and passive exercise effects. The platform provided in the present invention is a kind of universal platform, different casings can be designed on this basis to form different forms of equipment, such as a stepper, bedding fitness equipment and a gait trainer etc.

The foregoing description of the disclosed embodiments enables those skilled in the art to implement or use the present invention. Various modifications to these embodiments will be obvious to those skilled in the art, and the general principles defined herein can be implemented in other embodiments without departing from the spirit or scope of the present invention. Therefore, the present invention will not be limited to the embodiments shown in this description, but should conform to the widest scope consistent with the principles and novel features disclosed herein.

We claim:

1. A vertical oscillation auxiliary platform, comprising:

a pedestal, an upper cover tread board, a drive mechanism and a transmission mechanism; wherein the pedestal is used to support the drive mechanism and the transmission mechanism; the drive mechanism comprises a motor, wherein the motor is fixed on the pedestal, and the motor is transmissively connected with the transmission mechanism; wherein the transmission mechanism drives the upper cover tread board to make vertical up-and-down movements; wherein the transmission mechanism comprises a transmission shaft that is horizontally provided, the transmission shaft is pivoted by ball bearings and capable of free rotation; a belt pulley is provided on the transmission shaft, and the belt pulley is transmissively connected with an output shaft of the motor by one or more belts;

two sets of transmission assemblies are symmetrically provided on both sides of the transmission shaft, and an 8-shaped bearing block, a horizontal transmission rod and two triangular bearing blocks are provided in each of the two sets of transmission assemblies; wherein for each of the two sets of transmission assemblies, one end of the 8-shaped bearing block is an eccentric end, and another end thereof is a horizontal action end, a first circular hole is provided respectively on both ends of the 8-shaped bearing block and a ball bearing is provided in the circular hole;

three second circular holes are provided on an intermediate portion and both ends of the horizontal transmission rod; each of the two triangular bearing blocks comprises a fixing end, a horizontal action end and a vertical action end, a third circular hole is provided respectively in the fixing end, the horizontal action end and the vertical action end of each of the two triangular bearing blocks, and in the third circular hole is provided a ball bearing;

an eccentric bushing is provided respectively on both ends of the transmission shaft, and the eccentric bushing is connected in an axle hole of the ball bearing in the circular hole provided at the eccentric end of the 8-shaped bearing block; the first circular hole at the horizontal action end of the 8-shaped bearing block is connected with the second circular hole at the intermediate portion of the horizontal transmission rod by one or more connection pins; the second circular holes at both ends of the horizontal transmission rods are respectively connected with the third circular holes provided on the horizontal action ends of the triangular bearing blocks by the one or more connection pins; the third circular holes at the fixing ends of the triangular bearing blocks are respectively connected with pedestal connection pieces by the one or more connection pins and the pedestal connection pieces are fixed on the pedestal; and the third circular holes at the vertical action ends of the triangular bearing blocks are connected with upper cover connection pieces by the one or more connection pins, and the upper cover connection pieces are provided on a bottom portion of the upper cover tread board.

2. The vertical oscillation auxiliary platform according to claim 1, wherein the motor is installed on a motor fixing seat, and the motor fixing seat is connected on the pedestal.

3. The vertical oscillation auxiliary platform according to claim 1, wherein the drive mechanism comprises a control module, wherein the control module controls the motor to rotate.

4. The vertical oscillation auxiliary platform according to claim 1, wherein a level adjustment mechanism is provided on a bottom surface of the pedestal, and the level adjustment mechanism comprises height adjustment bolts provided on the bottom surface of the pedestal.

5. The vertical oscillation auxiliary platform according to claim 1, wherein one or more intermediate transmission pulleys are provided between the motor and the transmission mechanism so as to transmit power indirectly by the one or more intermediate transmission pulleys.

6. The vertical oscillation auxiliary platform according to claim 5, wherein when the intermediate transmission pulleys are provided to be two, the output shaft of the motor is connected to a first one of the intermediate transmission pulleys by belt transmission, the first one of the intermediate transmission pulley is connected to a second one of the intermediate transmission pulleys by a shaft, and the second one of the intermediate transmission pulleys is transmissively connected to the belt pulley provided on the transmission shaft.

* * * * *